US009599396B2

(12) United States Patent
Kibler et al.

(10) Patent No.: US 9,599,396 B2
(45) **Date of Patent: *Mar. 21, 2017**

(54) SYSTEM AND METHOD FOR PRODUCTION OF CRUDE ARGON BY CRYOGENIC RECTIFICATION OF AIR

(71) Applicants: Karl K. Kibler, Amherst, NY (US); Maulik R. Shelat, Williamsville, NY (US)

(72) Inventors: Karl K. Kibler, Amherst, NY (US); Maulik R. Shelat, Williamsville, NY (US)

(73) Assignee: PRAXAIR TECHNOLOGY, INC., Danbury, CT (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/987,863

(22) Filed: Jan. 5, 2016

(65) Prior Publication Data

US 2016/0131425 A1 May 12, 2016

Related U.S. Application Data

(63) Continuation of application No. 14/267,249, filed on May 1, 2014, now Pat. No. 9,291,389.

(51) Int. Cl.
*F25J 3/00* (2006.01)
*F25J 3/04* (2006.01)

(52) U.S. Cl.
CPC ..... *F25J 3/04666* (2013.01); *F25J 3/044* (2013.01); *F25J 3/048* (2013.01); *F25J 3/0443* (2013.01);
(Continued)

(58) Field of Classification Search
CPC .. F25J 3/04666; F25J 3/04672; F25J 3/04678; F25J 3/04703; F25J 3/0443;
(Continued)

(56) References Cited

U.S. PATENT DOCUMENTS 4,276,125 A * 6/1981 Issei ..... B01D 5/00 203/4
4,670,031 A 6/1987 Erickson
(Continued)

FOREIGN PATENT DOCUMENTS

| | | | |
|---|---|---|---|
| EP | 0 860 670 | A2 | 8/1998 |
| EP | 1 108 965 | A1 | 6/2001 |
| EP | 1 336 805 | A1 | 8/2003 |
| JP | H07 133982 | A | 5/1995 |
| JP | 2004-163003 | A | 6/2004 |
| JP | 2006-266532 | | 10/2006 |

*Primary Examiner* — Keith Raymond
(74) *Attorney, Agent, or Firm* — Robert J. Hampsch; David M. Rosenblum

(57) ABSTRACT

A system and method for producing argon that uses a higher pressure column, a lower pressure column, and an argon column collectively configured to produce nitrogen, oxygen and argon products through the cryogenic separation of air. The present system and method also employs a once through argon condensing assembly that is disposed entirely within the lower pressure column that is configured to condense an argon rich vapor stream from the argon column against the oxygen-enriched liquid from the higher pressure column to produce an argon liquid product. The control system is configured for optimizing the production of argon product by ensuring an even flow split of the oxygen-enriched liquid is distributed to the argon condenser cores and by adjusting the flow rate of the argon removed from the argon condensing assembly to maintain the liquid/vapor balance in the argon condensing assembly within appropriate limits.

13 Claims, 3 Drawing Sheets

(52) U.S. Cl.
CPC ..... *F25J 3/04193* (2013.01); *F25J 3/04412* (2013.01); *F25J 3/04672* (2013.01); *F25J 3/04678* (2013.01); *F25J 3/04703* (2013.01); *F25J 3/04727* (2013.01); *F25J 3/04806* (2013.01); *F25J 3/04884* (2013.01); *F25J 2200/06* (2013.01); *F25J 2200/54* (2013.01); *F25J 2215/58* (2013.01); *F25J 2250/02* (2013.01); *F25J 2250/04* (2013.01); *F25J 2250/20* (2013.01)

(58) Field of Classification Search
CPC ..... F25J 3/04412; F25J 3/048; F25J 3/04806; F25J 2200/06; F25J 2200/54; F25J 2215/58; F25J 2250/04
USPC ..... 62/651, 652, 924
See application file for complete search history.

(56) References Cited

U.S. PATENT DOCUMENTS

| | | | | |
|---|---|---|---|---|
| 4,756,731 | A | 7/1988 | Erickson | |
| 4,790,866 | A * | 12/1988 | Rathbone | F25J 3/0409 62/651 |
| 4,822,395 | A | 4/1989 | Cheung | |
| 5,114,449 | A | 5/1992 | Agrawal et al. | |
| 5,255,522 | A * | 10/1993 | Agrawal | F25J 3/04351 62/651 |
| 5,546,766 | A | 8/1996 | Higginbotham | |
| 5,916,261 | A | 6/1999 | Bonaquist et al. | |
| 6,397,632 | B1 | 6/2002 | Meagher | |
| 7,134,297 | B2 * | 11/2006 | Corduan | F25J 3/04412 62/643 |
| 9,291,389 | B2 * | 3/2016 | Kibler | F25J 3/04884 |
| 2012/0131951 | A1 | 5/2012 | Myobatake et al. | |

* cited by examiner

SYSTEM AND METHOD FOR PRODUCTION OF CRUDE ARGON BY CRYOGENIC RECTIFICATION OF AIR

CROSS REFERENCE TO RELATED APPLICATIONS

The present application is a continuation application and claims the benefit of and priority to U.S. patent application Ser. No. 14/267,249 filed on May 1, 2014.

TECHNICAL FIELD

The present invention is related to a process for the cryogenic distillation of air using a multiple column distillation system to produce argon in addition to nitrogen and/or oxygen.

BACKGROUND OF THE INVENTION

Argon is a highly inert element used in the some high-temperature industrial processes, such as steel-making where ordinarily non-reactive substances become reactive. Argon is also used in various types of metal fabrication processes such as arc welding as well as in the electronics industry, for example in silicon crystals growing processes. Still other uses of argon include medical, scientific, preservation and lighting applications.

Argon constitutes a minor portion of ambient air (i.e. 0.93%), yet it possesses a relatively high value compared to the oxygen and nitrogen products recovered from air separation units. Argon is typically recovered from the Linde-type double column arrangement by extracting an argon rich draw from the upper column and directing the stream to a third column or crude argon column to recover the argon. Crude argon produced in this "superstaged" distillation process typically includes an argon condensing unit disposed within the argon column or situated between the argon column and the upper column of the Linde-type double column arrangement to produce the argon product. The argon condensation load is typically imparted to a portion of the oxygen rich column bottoms (e.g. kettle) prior to its introduction into the lower pressure distillation column.

Drawbacks of the typical three column argon producing air separation unit are the additional capital costs associated with argon recovery and the resulting column/coldbox heights, often in excess of 200 feet, are required to recover the high purity argon product. As a consequence, considerable capital expense is incurred to attain the high purity argon, including capital expense for split columns, multiple coldbox sections, argon condensing assembly, liquid reflux/return pumps, etc.

One particular concern is the argon condensing assembly used in many conventional air separation plants. The conventional argon condensing assembly consists of a large separation vessel containing multiple thermo-syphon type condensers and due to its size and external plumbing requirements and often increases the height of the air separation cold box. Some prior art solutions have addressed the column/coldbox heights by placing the argon condensing assembly in a separate vessel that is hung between the argon column and the low pressure column in lieu of stacking the argon condensing assembly above the argon column. In either arrangement, the argon vapor is typically drawn into the top of each condensing assembly via a manifold and is completely condensed with a portion of the kettle liquid from the higher pressure column or with cold vapor from the lower pressure column. In many prior art argon condensing assemblies, the condenser is disposed in a large separation vessel and partially submerged in a bath of the kettle liquid. The kettle liquid is typically drawn into the bottom of the condensers and flows upwards, boiling as it absorbs heat from the argon vapor. From a safety perspective, it is crucial to prevent complete vaporization of the kettle liquid within the boiling passages to ensure that there is adequate liquid to keep the surfaces are wetted. This is particularly important where the kettle liquid input to each condense is a two phase flow.

There is a continuing need to develop an improved argon recovery process or arrangement which can enhance the safety, performance and cost-effectiveness of argon recovery in cryogenic air separation units, and in particular, to develop a more compact lower cost argon condensing assembly.

SUMMARY OF THE INVENTION

The present invention may be characterized as a method for producing argon by the cryogenic rectification of feed air comprising: (a) directing feed air into a higher pressure column configured to produce oxygen-enriched liquid and a nitrogen-rich stream by cryogenic rectification within the higher pressure column; (b) withdrawing the nitrogen rich stream from the higher pressure column and directing it a lower pressure column configured to produce an oxygen product stream and a nitrogen-rich product stream or waste stream by cryogenic rectification within the lower pressure column; (c) withdrawing an argon-oxygen-containing side stream from the lower pressure column and directing it an argon column configured to produce an argon-rich vapor stream and a bottoms liquid by cryogenic rectification within the argon column; (d) directing the bottoms liquid from the argon column to the lower pressure column; (e) directing the argon rich vapor stream to an argon condensing assembly disposed within the lower pressure column; (f) withdrawing the oxygen-enriched liquid from the higher pressure column and directing it to the argon condensing assembly, the argon condensing assembly configured to condense the argon rich vapor stream against the oxygen-enriched liquid from the higher pressure column to produce an argon-rich liquid stream and a partially vaporized oxygen-rich stream; (g) releasing the partially vaporized oxygen-rich stream into the lower pressure column; and (h) removing the argon-rich liquid stream from the argon condensing assembly; wherein a portion of the argon-rich liquid stream is removed from the argon condensing assembly as the argon product. In addition, any or all of the oxygen-enriched liquid from the higher pressure column is directed to lower pressure column only via the argon condensing assembly.

The present invention may also be characterized as a system for producing argon by the cryogenic rectification of feed air comprising: (i) a source of purified and compressed feed air; (ii) a higher pressure column configured to produce oxygen-enriched liquid and a nitrogen-rich stream by cryogenic rectification of the feed air within the higher pressure column; (iii) a lower pressure column configured to receive the nitrogen rich stream from the higher pressure column and produce an oxygen product stream and a nitrogen-rich product stream or waste stream by cryogenic rectification within the lower pressure column; (iv) an argon column operatively coupled to the lower pressure column and configured to receive an argon-oxygen-containing side stream from the lower pressure column and produce an argon-rich vapor stream and a bottoms liquid by cryogenic rectification within the argon column, wherein the bottoms liquid from the argon column is recycled back to the lower pressure column; and (v) an argon condensing assembly disposed within the lower pressure column and configured to receive the argon rich vapor stream from the argon column and the oxygen-enriched liquid from the higher pressure column and to condense the argon rich vapor stream against the oxygen-enriched liquid from the higher pressure column to produce an argon-rich liquid stream and a partially vaporized oxygen-rich stream; the argon condensing assembly is further configured to releasing the partially vaporized oxygen-rich stream into the lower pressure column wherein a portion of the argon-rich liquid stream is removed from the argon condensing assembly as the argon product. As with the above-described method, any or all of the oxygen-enriched liquid from the higher pressure column is directed to the lower pressure column only via the argon condensing assembly. Preferably, the argon condensing assembly comprises a once-through argon condenser core, and in some embodiments two or more once-through argon condenser cores.

Additional features, elements and/or steps associated with the present inventions include a control system for controlling the production of argon product by adjusting the flow rate of the argon-rich liquid stream removed from the argon condensing assembly to maintain the liquid/vapor balance of the partially vaporized oxygen-rich stream in the argon condensing assembly within appropriate limits. in the embodiments using multi-core argon condensing assembly, the control system is further configured to control the production of argon product by adjusting the flow of the oxygen-enriched liquid from the higher pressure column to the argon condensing assembly such that a generally even flow split of the oxygen-enriched liquid is distributed to the two or more argon condenser cores and to ensure sufficient liquid is present to keep surfaces of the argon condenser cores wetted.

BRIEF DESCRIPTION OF THE DRAWINGS

The above and other aspects, features, and advantages of the present invention will be more apparent from the following, more detailed description thereof, presented in conjunction with the following drawings, in which.

For the sake of avoiding repetition, some of the common elements in the various FIGS. utilize the same numbers where the explanation of such elements would not change from FIG. to FIG.

DETAILED DESCRIPTION

Figure 1:
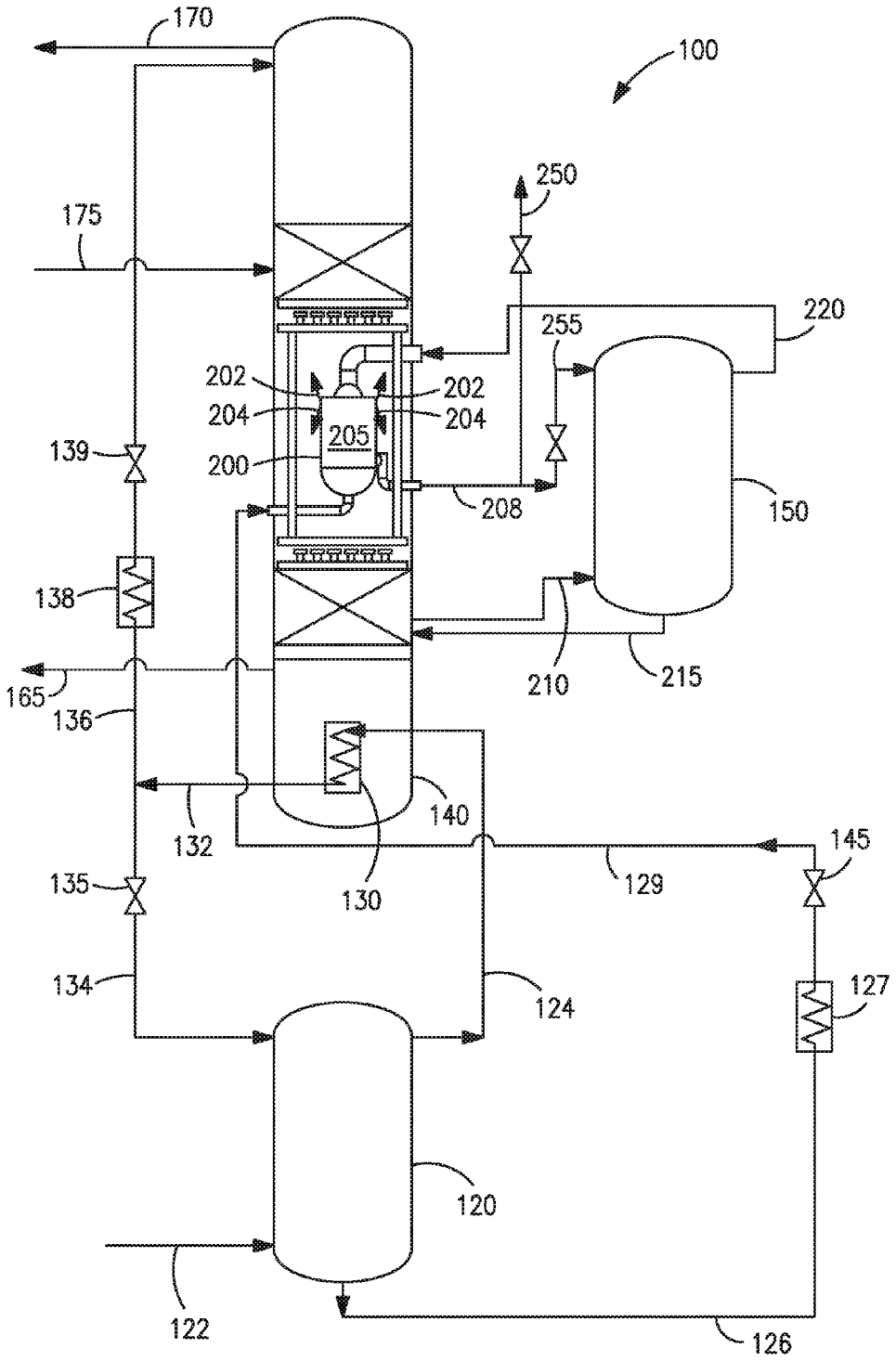
FIG. 1 shows a general schematic illustration of a portion of a cryogenic air separation unit configured to produce nitrogen, oxygen and argon products using a three column system in accordance with the present invention.

To aid in the understanding of the present argon recovery system and process, it is useful to understand the general process for the cryogenic separation of air to produce nitrogen, oxygen and argon products using a three column system. With reference to FIG. 1, a clean, pressurized air stream is introduced into the air separation process. This clean, pressurized air stream is generally divided into two or more column feed streams, the first of which is cooled in a main heat exchanger (not shown) and fed directly to the high pressure distillation column 120 via line 122, where it is rectified into a nitrogen-rich overhead stream and a crude liquid oxygen bottoms or kettle liquid as it is commonly known. The second column feed stream or second portion of the teed air is also cooled in the main heat exchanger, expanded, and subsequently fed via line 175 to the low pressure distillation column 140 at an upper-intermediate location.

The nitrogen-rich overhead stream produced in the higher pressure distillation column 120 is removed from high pressure column 120 via line 124 and condensed in reboiler/condenser 130, which is typically located in the bottoms liquid sump of low pressure distillation column 140. Upon condensing, the nitrogen-rich liquid stream is removed from reboiler/condenser 130, via line 132, and split into two or more portions. A first portion is returned to the top of high pressure distillation column 120, via line 134 and valve 135 to provide reflux whereas a second portion in line 136, is sub-cooled in heat exchanger 138, reduced in pressure by valve 139 and fed to a location near the top of low pressure column 140 as reflux.

The crude liquid oxygen bottoms or kettle liquid from high pressure distillation column 120 is removed via line 126, sub-cooled in heat exchanger 127, reduced in pressure via valve 145, and directed to the argon condensing assembly 200 where it is heat exchanged with crude argon vapor overhead from the argon distillation column 150 wherein it is partially vaporized. The vapor portion of the partially vaporized stream is released (shown as arrows 202) at an intermediate location of low pressure distillation column 140 for rectification. Similarly, the liquid portion of the partially vaporized stream is also released at (shown as arrows 204) an intermediate location of low pressure distillation column 140 for rectification.

An argon-oxygen-containing side stream is removed from a lower-intermediate location of low pressure distillation column 140 and fed via line 210, to argon distillation column 150 for rectification into a argon-rich overhead stream and a bottoms liquid which is recycled via line 215, back to the low pressure distillation column 140. The argon-rich overhead stream is removed from argon distillation column 150 via line 220 and is then fed to the argon condensing assembly 200 where the argon-rich stream is condensed against the sub-cooled, crude liquid oxygen bottoms from the high pressure distillation column 120. A portion of the condensed crude argon is returned to argon distillation column 150 via line 255 to provide reflux while a portion of the crude liquid argon may be removed as product via line 250.

To complete the air separation cycle, a low pressure nitrogen-rich overhead is removed via line 170 from the top of low pressure distillation column 140, warmed to recover refrigeration in the main heat exchangers (not shown), and removed from the process as low pressure nitrogen product. An oxygen-enriched vapor stream is removed, via line 165, from the vapor space in low pressure distillation column 140 above reboiler/condenser 130, warmed in a heat exchanger (not shown) to recover refrigeration and removed from the process as gaseous oxygen product. Although not shown, an upper nitrogen-rich vapor stream may also be removed from low pressure distillation column 140, warmed to recover refrigeration in the main heat exchangers (not shown), and then vented from the process as waste.

Figure 2:
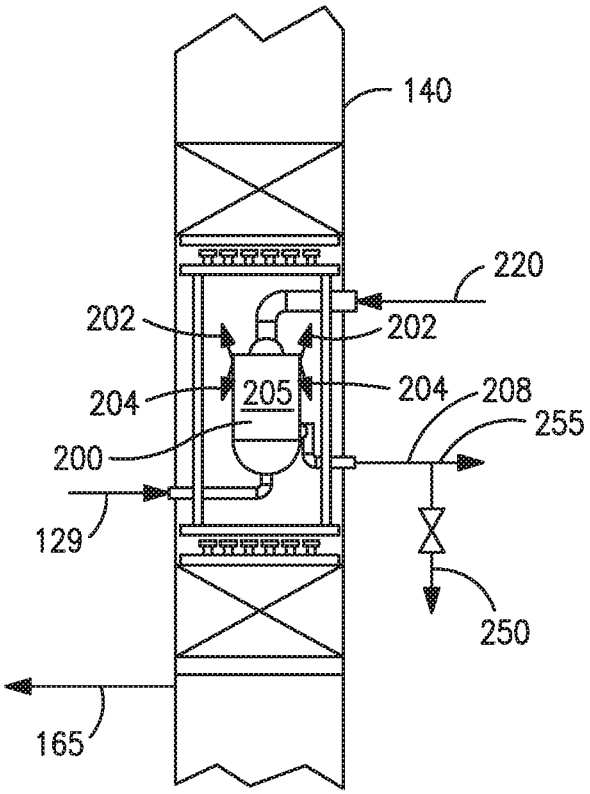
FIG. 2 shows a schematic illustration of the argon condensing assembly in accordance with the present invention.

The present system and method for argon recovery and its advantages will now be described in more detail with reference to FIGS. 1-3. The illustrated embodiments provide an improved method and arrangement for argon recovery from an air separation system 100 configured with a high pressure distillation column 120, a low pressure distillation column 140 and a crude argon column 150. As seen therein, the improved method and arrangement for argon recovery comprises condensing the argon-rich, overhead vapor 220 from the top of the crude argon column 150 in an argon condensing assembly 200 disposed at an intermediate location within the low pressure distillation column 140, The argon-rich vapor in line 220 is condensed in the argon condensing assembly 200 via indirect heat exchange with the entire kettle liquid flow fed via line 129 from the high pressure distillation column 120.

The argon condensing assembly 200 preferably comprises one or more once-through argon condenser cores 205 and disposed at an intermediate location within the low pressure distillation column 140 where the argon-rich overhead vapor from the argon distillation column 150 flows in a counter flow arrangement against sub-cooled and lower pressure kettle liquid or bottoms liquid from the high pressure distillation column 120. The boil-up from the argon condensing assembly 200 would be a two phase (vapor/liquid) stream 202, 204 that is released into lower pressure column 140 for rectification. The condensed, argon-rich liquid is removed from a location proximate the bottom of the argon condensing assembly 200 via line 208 and split into two portions. The first portion is fed to the top of the crude argon column 150 via line 255 to provide reflux for the argon column 150. The second portion is removed from the process via line 250 as crude liquid argon product.

Figure 3:
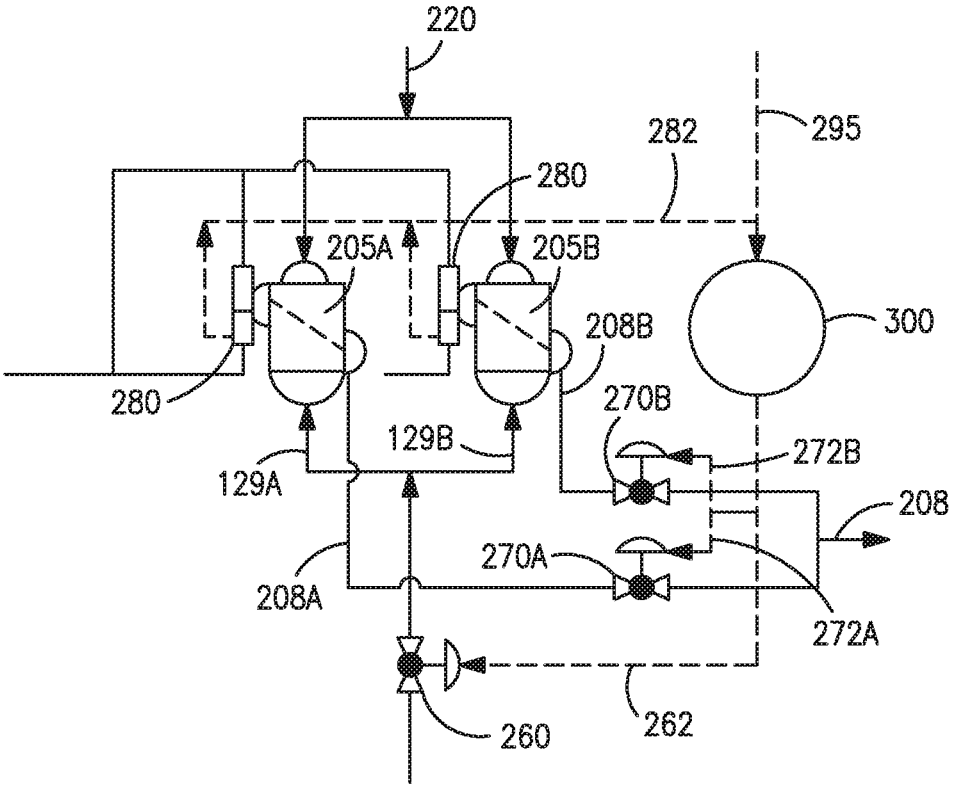
FIG. 3 shows a schematic illustration of a control scheme useful in conjunction with the present embodiments of the argon condensing assembly used in the argon recovery system and methods disclosed herein.

Operational control of the present argon recovery method and system is achieved, in part, with a control system comprising two distinct control features or elements, broadly depicted in FIG. 3. The first control feature or element provides an even flow split of the kettle liquid 129A, 129B between multiple argon condenser cores 205A, 205B to ensure sufficient liquid is present to keep the surfaces of all argon condenser cores wetted. The second control feature or element provides control of the argon flow 208A, 208B removed from each argon condenser core 205A, 205B to maintain the liquid/vapor balance in each argon condenser core 205A, 205B within appropriate limits. In addition, this second control feature or element also operates to adjust the split of liquid argon to be used as reflux for the argon column and to be removed as crude argon product in order to optimize argon recovery.

The present argon recovery control system preferably comprises a controller 300 operatively coupled to one or more control valves 260, 270A, 270B associated with the supply of the sub-cooled kettle liquid 129A, 129B to the argon condenser cores 205A, 205B and with the removal of condensed argon 208A, 208B from the argon condenser cores 205A, 205B. In particular, one or more control valves 260 are disposed upstream of the argon condenser cores 205A, 205B and in association with the kettle liquid supply. In addition, argon flow regulating valves 270A, 270B are preferably disposed downstream of the argon condenser core outlets.

Such argon flow regulating valves 270A, 270B operatively control or adjust the argon flow removed from each argon condenser cores 205A, 205B and maintain the liquid/vapor balance in each argon condenser core within appropriate limits. The argon flow regulating valves 270A, 270B may also be configured to adjust the split of liquid argon to be used as reflux for the argon column and to be removed as crude argon product. Both the control valves 260 and the argon flow regulating valves 270A, 270B are responsive to various inputs and feedback including the liquid/vapor balance in the kettle liquid exiting each argon condenser core 205A, 205B as measured by one or more liquid to vapor mass flow ratio indicators 280 as well as the differences in the liquid/vapor balance exiting each argon condenser core 205A, 205B ascertained by a differential level sensor.

When using multiple argon condensing cores as depicted in FIG. 3, it is also important to control the condensing rates of the condenser cores such that the performance and/or output of each condenser core is similar or comparable. Control of the argon recovery system and process is achieved, in part, by controlling the flow of the kettle liquid from the high pressure column to the argon condenser cores via valve 260 controlled via signal 262 with the aim to ensure a sufficient and generally even split of the kettle flow to each argon condenser core. To achieve such control, the quality characteristics of the boiling liquid or kettle liquid exiting each argon condenser core 205A, 205B are measured and compared. If one argon condenser core has an exit stream of higher quality than the other condenser core or cores, the condensing rate of that one argon condenser core is reduced to generally match the exit quality of the other condenser cores. Specifically, the amount of liquid and gas in the kettle exit flow as measured by indicators 280 and signals 282 is used to determine the differential liquid to vapor mass flow ratio (L/V) between different argon condenser cores. This difference in L/V is provided as an input and/or feedback to the present control system along with other system flow measurement signals 295.

Using the difference in L/V as a control parameter, the kettle flow to an argon condenser core is adjusted until the measured exit quality of the condenser core is within an allowable range of the other condenser cores. Since the control valves 260 also regulate the liquid level in the kettle of the higher pressure column, the control algorithm must control with feedback from a lower column level indicator and the L/V measurements via input signal 295. In conjunction with the flow control, the argon flow regulating valve can also used to regulate the condensing load on the condenser cores to reduce or increase the condensing load as needed.

Increasing the argon liquid level in the argon condenser core generally decreases the heat transfer performance of the argon condenser core which reduces the condensing rate. The difference in L/V measurements is also used to adjust the valve position of the argon regulating valves 270A, 270B via signal 272A and 272B until the exit quality of each condenser core is within an allowable range of the other condenser cores. However the present control system must also control the rate of argon flow from the lower pressure column to the argon column. Therefore the preferred control algorithms must adjust the argon regulating valve position with feedback from both an argon flow indicator as well as the L/V measurements.

To help achieve an even flow and mix of kettle liquid and vapor to each argon condenser core a generally symmetrical pipe network to and from each condenser core as well as a common distributor is used. For two condensers a vertically oriented symmetric Y-shaped adapter or fitting is used to split the two phase flow to each argon condenser core. Similar fittings can be employed where the argon recovery system uses more than two argon condenser cores. Other portions of the argon recovery system piping network such as pipe lengths, pipe diameter, and elevation or directional changes are generally kept equivalent or similar for each argon condenser core.

A common distributor is coupled to the inlet header of each argon condenser core. The distributor is used to mix and evenly distribute the two phase kettle flow which enters the argon condenser cores. Using a distributor ensures sufficient kettle liquid is distributed to each condenser core and prevents dryout in portions of the condenser cores. The preferred distributor is a perforated plate or baffle due to its low pressure drop and simplicity.

One of the key differences or improvements of the present system and method compared to the prior art argon recovery systems and methods is that the entire flow of kettle liquid from the high pressure column is directed to the argon condensing assembly. Providing the full flow of kettle liquid to the argon condensing assembly and not diverting any of the kettle liquid flow simplifies the packaging and ensures that localized or periodic boiling to dryness within the condenser will be prevented which improves the safety aspect of the argon recovery in that avoids hydrocarbon deposition on surfaces within the argon condensing assembly.

One key cost advantage of the present system and method include the fact that no separate vessel is required to house the argon condensing assembly. Another key advantage is the reduced or simplified piping, valve and column packages required by the present system resulting in potentially reduced cold box height. Lastly, the control system and scheme also provides certain advantages to ensure a safe and balanced operation of the argon recovery system and process.

While the present invention has been described with reference to preferred embodiments, as will be understood by those skilled in the art, numerous additions and omissions can be made without departing from the spirit and scope of the present invention as set forth in the appended claims.

What is claimed is:

1. A method for producing crude argon by cryogenic rectification of a feed air stream comprising the steps of:

(a) compressing and purifying the feed air stream;

(b) directing a portion of the compressed and purified feed air stream into a higher pressure column configured to produce an oxygen-enriched liquid and a nitrogen-rich overhead stream by cryogenic rectification within the higher pressure column;

(c) directing the nitrogen rich overhead stream from the higher pressure column to a lower pressure column configured to produce an oxygen product stream and a nitrogen-rich stream by cryogenic rectification within the lower pressure column;

(d) directing an argon-oxygen-containing stream from within the lower pressure column to an argon column configured to produce an argon-rich vapor stream and an argon-oxygen containing liquid by cryogenic rectification within the argon column;

(e) recycling the argon-oxygen containing liquid from the argon column to the lower pressure column;

(f) directing the argon rich vapor stream from the argon column to an argon condensing assembly disposed within the lower pressure column;

(g) directing a flow of the oxygen-enriched liquid from the higher pressure column to the argon condensing assembly disposed within the lower pressure column;

(h) condensing the argon rich vapor stream against the entire flow of the oxygen-enriched liquid from the higher pressure column to produce a crude argon-rich liquid stream and a partially vaporized oxygen-rich stream;

(i) releasing the partially vaporized oxygen-rich stream from the argon condensing assembly into the lower pressure column; and (j) removing the crude argon-rich liquid stream from the argon condensing assembly;

wherein the flow of the oxygen-enriched liquid from the higher pressure column to the argon condensing assembly is sufficient to keep surfaces of the argon condensing assembly wetted and prevent the argon condensing assembly from boiling to dryness.

2. The method of claim 1 further comprising the step of returning a portion of the crude argon-rich liquid stream to the argon column as reflux.

3. The method of claim 1 further comprising the step of adjusting a flow rate of the crude argon-rich liquid stream removed from the argon condensing assembly to maintain a liquid/vapor balance of the partially vaporized oxygen-rich stream in the argon condensing assembly.

4. The method of claim 1 wherein the argon condensing assembly comprises a once-through argon condenser core.

5. The method of claim 1 wherein the argon condensing assembly comprises two or more once-through argon condenser cores.

6. The method of claim 5 further comprising the step of adjusting a flow rate of the crude argon-rich liquid stream removed from the argon condensing assembly to maintain a liquid/vapor balance of the partially vaporized oxygen-rich stream in each of the argon condenser cores.

7. The method of claim 5 further comprising the step of adjusting the flow of the oxygen-enriched liquid from the higher pressure column to the argon condensing assembly such that an even flow split of the oxygen-enriched liquid is distributed to the two or more argon condenser cores and to ensure sufficient liquid is present to keep surfaces of the argon condenser cores wetted.

8. A system for producing a crude argon product by cryogenic rectification of a feed air stream comprising:

a source of compressed and purified feed air;

a higher pressure column configured to produce an oxygen-enriched liquid and a nitrogen-rich overhead stream by cryogenic rectification of a portion of the compressed and purified feed air within the higher pressure column;

a lower pressure column configured to receive the nitrogen rich stream from the higher pressure column and produce an oxygen product stream and a nitrogen-rich product stream or waste stream by cryogenic rectification within the lower pressure column;

an argon column operatively coupled to the lower pressure column and configured to receive an argon-oxygen-containing stream from the lower pressure column and produce an argon-rich vapor stream and an argon-oxygen containing liquid by cryogenic rectification within the argon column, wherein a portion of the argon-oxygen containing liquid is recycled from the argon column to the lower pressure column; and an argon condensing assembly disposed within the lower pressure column and configured to receive the argon rich vapor stream from the argon column and to receive the oxygen-enriched liquid from the higher pressure column and to condense the argon rich vapor stream against the entire flow of the oxygen-enriched liquid from the higher pressure column to produce a crude argon-rich liquid stream and a partially vaporized oxygen-rich stream; the argon condensing assembly is further configured to release the partially vaporized oxygen-rich stream into the lower pressure column;

at least one control valve disposed upstream of the argon condensing assembly and configured to control the flow of the oxygen-enriched liquid from the higher pressure column to the argon condensing assembly, wherein the flow of the oxygen-enriched liquid from the higher pressure column to the argon condensing assembly is sufficient to keep surfaces of the argon condensing assembly wetted and prevent the argon condensing assembly from boiling to dryness; and wherein a portion of the crude argon-rich liquid stream is extracted from the argon condensing assembly as the crude argon product.

9. The system of claim 8 wherein a portion of the crude argon-rich liquid stream is recycled back to the argon column as reflux.

10. The system of claim 8 further comprising another control valve disposed downstream of the argon condensing assembly and configured to control the flow of the crude argon-rich liquid stream removed from the argon condensing assembly to maintain a liquid/vapor balance of the partially vaporized oxygen-rich stream in the argon condensing assembly.

11. The system of claim 8 wherein the argon condensing assembly comprises a once-through argon condenser core.

12. The system of claim 8 wherein the argon condensing assembly comprises two or more once-through argon condenser cores.

13. The system of claim 12 further comprising another control valve disposed downstream of the argon condensing assembly and configured to control the flow of the crude argon-rich liquid stream removed from the argon condensing assembly to maintain a liquid/vapor balance of the partially vaporized oxygen-rich stream in the argon condensing assembly.

* * * * *